United States Patent [19]

Hegarty

[11] 4,383,382

[45] May 17, 1983

[54] SELF-LUMINOUS SAFETY SIGN

[75] Inventor: William Hegarty, New Rochelle, N.Y.

[73] Assignee: Self-Powered Lighting Inc., Elmsford, N.Y.

[21] Appl. No.: 192,792

[22] Filed: Oct. 1, 1980

[51] Int. Cl.[3] ..... G08B 7/00; G09F 13/26

[52] U.S. Cl. ..... 40/545; 40/570; 40/575

[58] Field of Search ..... 40/545, 570, 546, 582, 40/564, 581, 575, 576, 574, 542

[56] References Cited

U.S. PATENT DOCUMENTS

| | | | |
|---|---|---|---|
| 1,858,755 | 5/1932 | Van Wyck et al. | 40/564 |
| 1,944,276 | 1/1934 | Schepmoes | 40/545 |
| 2,029,221 | 1/1936 | Burgess et al. | 40/574 |
| 3,038,271 | 6/1962 | MacHutchin et al. | 40/542 |
| 3,402,492 | 9/1968 | Clapham, Jr. . | |
| 3,571,999 | 3/1971 | Downing | 40/908 |
| 3,780,462 | 12/1973 | Pregel et al. | 40/570 |
| 3,916,404 | 10/1975 | Gouge | 40/570 |
| 4,228,596 | 10/1980 | Daniel | 40/575 |
| 4,261,125 | 4/1981 | Rappaport | 40/564 |

FOREIGN PATENT DOCUMENTS

| | | | |
|---|---|---|---|
| 2613024 | of 1977 | Fed. Rep. of Germany | 40/564 |
| 770857 | of 1934 | France | 40/564 |
| 1511003 | of 1968 | France | 40/564 |

*Primary Examiner*—Robert Peshock
*Assistant Examiner*—Michael J. Foycik
*Attorney, Agent, or Firm*—Blum, Kaplan, Friedman, Silberman & Beran

[57] ABSTRACT

A self-luminous safety sign with variable legend capability. A housing supports a faceplate having safety warnings or symbols thereon. Self-luminous lights, adapted to illuminate selected characters or symbols on the faceplate without external electrical connections, are selectively mounted in the housing. The lights are removable from and displaceable within the housing so that the desired characters or symbols on the faceplate can be illuminated.

22 Claims, 7 Drawing Figures

SELF-LUMINOUS SAFETY SIGN

BACKGROUND OF THE INVENTION

This invention is directed to a self-luminous safety sign having self-luminous lights which can be selectively removed from or displaced within a housing for illuminating desired portions of the sign.

Illuminated safety signs, such as EXIT and NO SMOKING signs, are utilized in commercial or institutional settings to warn or advise readers thereof of various information. The safety signs of the prior art generally include a permanently mounted faceplate and permanently mounted lighting fixtures in a sign housing. Accordingly, a user of the prior art signs would be prohibited from changing the faceplate to provide alternative safety warnings and from removing or displacing the lighting fixtures therein except to change a bulb or the like. Accordingly, such a user, should the circumstances present themselves, would not be able to alter the information on the sign or freely change its location. A user of the prior art sign would therefore be required to purchase a new sign to meet his needs.

For example, a purchaser who purchases an EXIT sign with an arrow pointing to the right would not be able to mount the sign to the right of the exit to which it points since the arrow would then be pointing in the wrong direction.

Accordingly, a self-luminous safety sign which allows for the replacement or change of the faceplate and which has self-luminous lights which can be selectively positioned or removed so that desired portions of the faceplate can be illuminated, is desired.

SUMMARY OF THE INVENTION

Generally speaking, in accordance with the instant invention, a safety sign is provided including self-luminous lighting fixtures. The safety sign is adapted to receive alternative legend-bearing faceplates, such as EXIT or NO SMOKING, depending on its desired use and location. Self-luminous lights, which provide lighting without external electrical connections, are selectively securable in a sign housing in order to illuminate selected portions of the faceplate. The lights are removable from and displaceable within the sign housing so that the desired portions of the faceplate can be illuminated.

Accordingly, it is an object of the instant invention to provide an improved self-luminous safety sign with interchangeable legend-bearing faceplates.

Another object of the instant invention is to provide a self-luminous safety sign which does not require the use of external electrical connections in order to operate.

A further object of the instant invention is to provide a self-luminous safety sign having selectively displaceable and removable lights allowing for the illumination of desired portions of the faceplate.

A still further object of the instant invention is to provide a self-luminous safety sign which is easily and inexpensively constructed.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
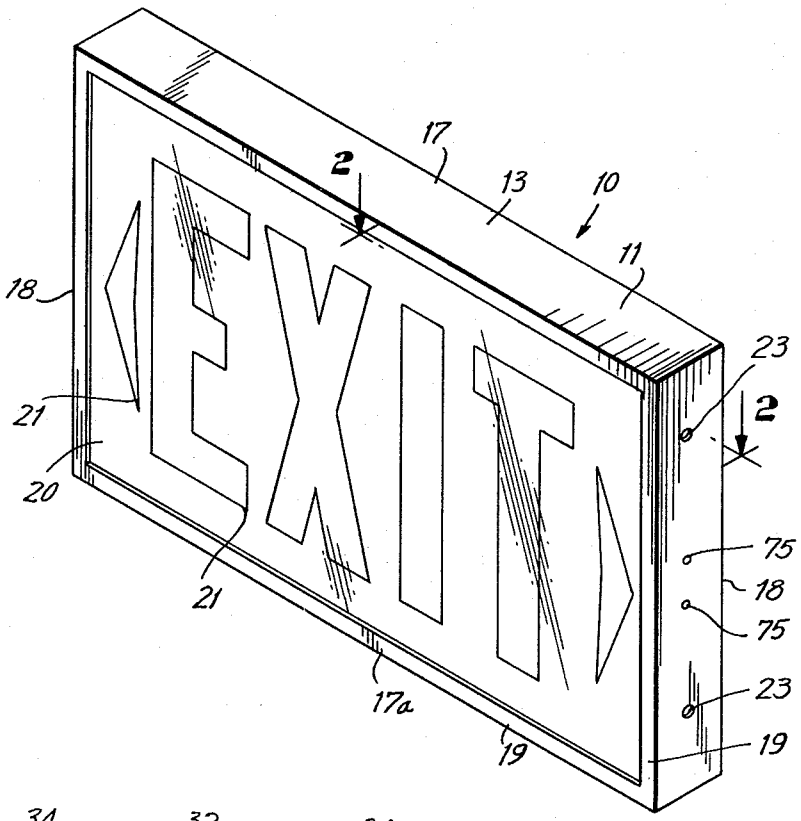
FIG. 1 is perspective view of a self-luminous safety sign constructed in accordance with the instant invention.

Reference is first made to FIG. 1 wherein a self-luminous safety sign, generally indicated at 10, constructed in accordance with the instant invention, is depicted. Sign 10 includes a housing 11 which supports a legend-bearing faceplate 20. As illustrated, faceplate 20 includes a plurality of light transmitting characters or symbols 21, which in the sign depicted, are letters forming the word EXIT with elongated arrows on either side thereof. It is noted that a variety of safety legends or warnings can be imprinted on faceplate 20 depending on the purpose for which sign 10 is to be utilized. For example, instead of bearing the safety legend EXIT with two arrows, the safety legend on faceplate 20 could be EXIT with a single arrow, an EXIT sign without arrows, DANGER, FIRE ESCAPE, FIRE EXTINGUISHER, STAIRWAY, or the international safety symbols such as the handicapped wheelchair symbol.

Faceplate 20 can be constructed from a plastic material such as Lexan or Plexiglas. The light transmitting regions on faceplate 20, which define the characters or symbols, can be openings therein or translucent regions or the like. The remainder of the surface of faceplate 20 is generally blackedout by dark painting or the like so that substantially all light from the lighting fixtures behind faceplate 20, as explained in detail below, is blocked from passing therethrough. For example, in the EXIT sign depicted in FIG. 1, the regions where light is to be transmitted through faceplate 20, namely the letters or arrows, can be substantially white translucent areas. The remainder of the surface of faceplate 20 can be painted safety red so that substantially all light is blocked from passing therethrough. Accordingly, the lighting fixtures in housing 11 behind faceplate 20, as described in detail below, can be focused on the light transmitting regions on faceplate 20 thereby properly illuminating the characters or symbols, with the blackedout areas on faceplate 20 substantially preventing the focused light from passing therethrough.

Figure 2:
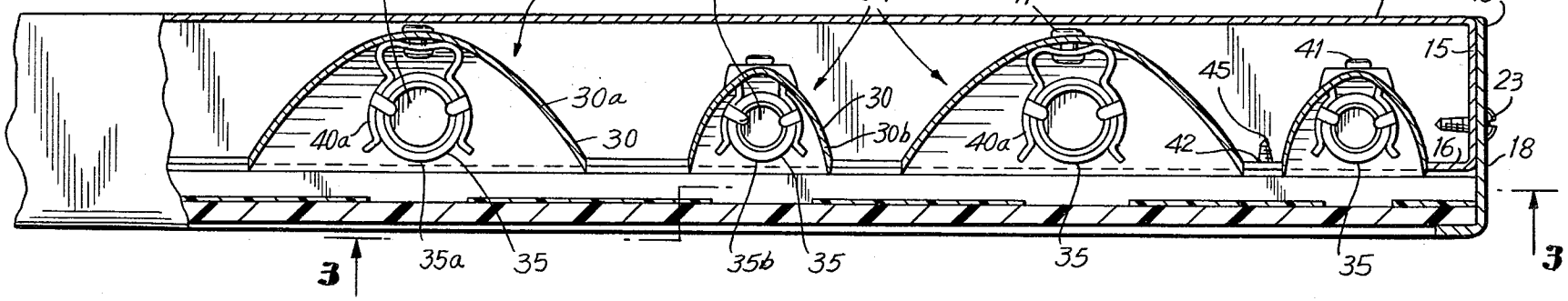
FIG. 2 is an enlarged sectional view taken along lines 2—2 of FIG. 1.
Figure 4:
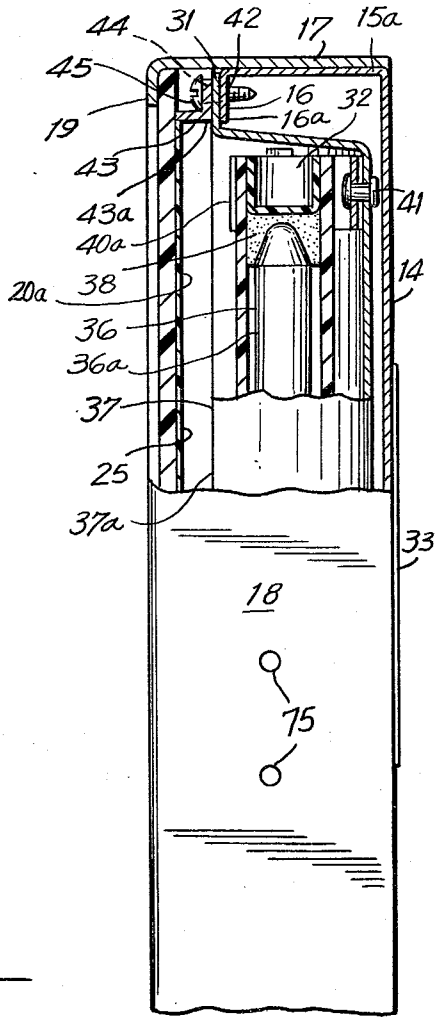
FIG. 4 is a sectional view taken along lines 4—4 of FIG. 3.
Figure 3:
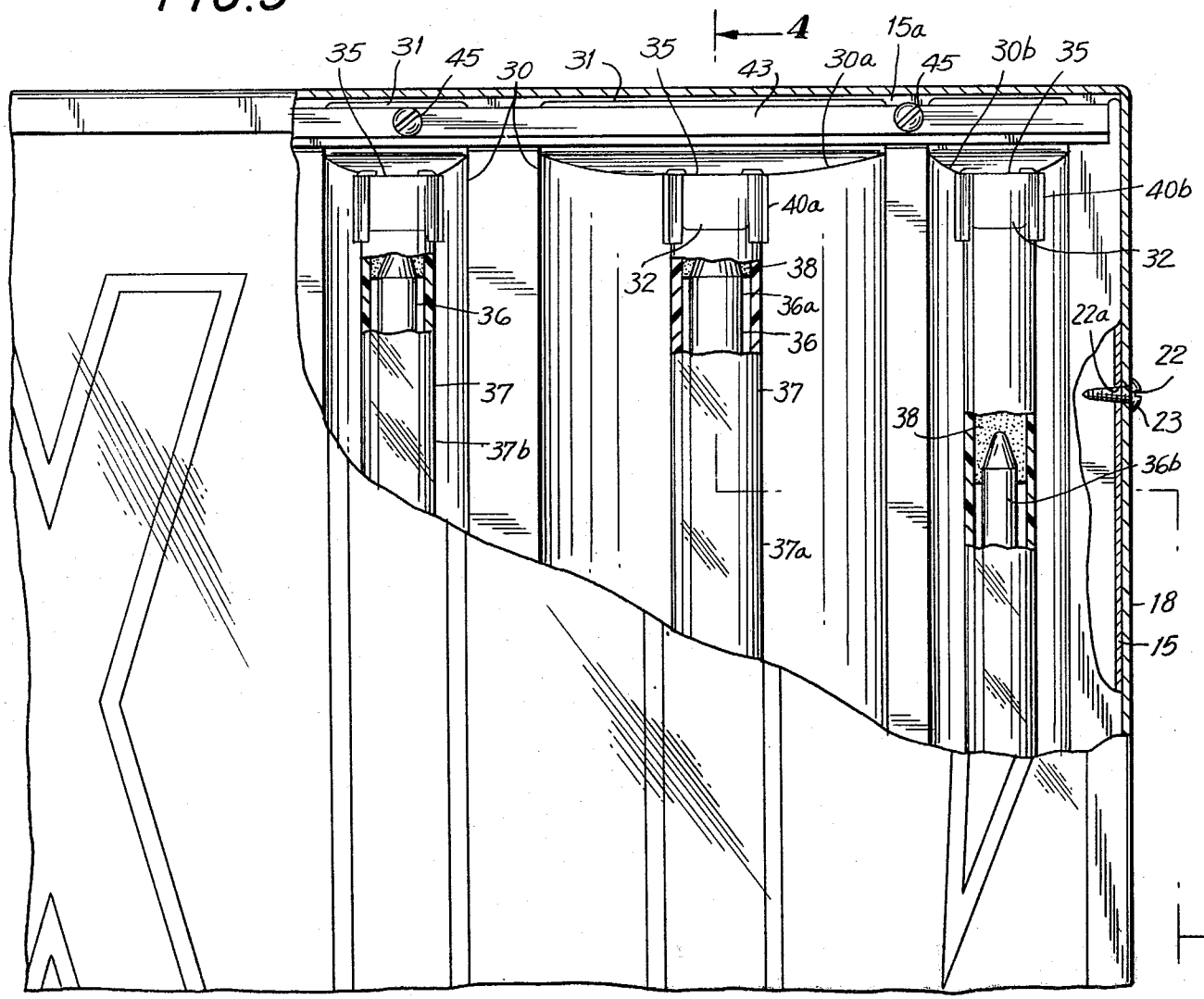
FIG. 3 is a sectional view taken along lines 3—3 of FIG. 2.

Referring now to FIGS. 2 through 4 in addition to FIG. 1, housing 11 includes a back frame 12 and a front frame 13. Back frame 12 includes a back portion 14 and side walls 15 which extend perpendicularly from back portion 14 around the perimeter thereof. Additionally, back frame 12 includes extending shoulders 16 which extend substantially perpendicular from side walls 15, shoulders 16 being substantially parallel to back portion 14.

Front frame 13 includes top and bottom walls 17 and 17*a* respectively and side walls 18. A securing lip extends perpendicularly from top wall 17, bottom wall 17*a* and side walls 18 for securing faceplate 20 in housing 11 in the manner to be discussed below. Holes 22 and 22*a* are bored through side walls 18 of front frame 13 and side walls 15 of back frame 12, respectively, for receiving screws 23, screws 23 being adapted to secure front frame 13 to back frame 12.

Lighting fixtures, generally indicated as 34, include reflectors 30 which are removably and displaceably mounted in back frame 12 in the manner to be discussed below. Reflectors 30 are generally parabolic in shape and can be constructed in various widths depending on the area of the characters or symbols 21 on faceplate 20 to be illuminated. As illustrated, both large reflectors 30*a* and small reflectors 30*b* are provided. A lighting element 35 is mounted in each reflector 30. A large lighting element 35*a* is mounted in large reflector 30*a*. Similarly, a small lighting element 35*b* is mounted in small reflector 30*b*. Lighting elements 35 are preferably tritium-gas filled light elements.

It is noted that reflector 30 need not be parabolic in shape, but can be variously constructed and shaped to properly focus the light from lighting elements 35 to the desired regions of faceplate 20. Also, one lighting element 35 can be focused, by means of a properly contoured reflector, to the desired regions of faceplate 20. Finally, a plurality of lighting elements 35 can be arranged in combination with a single reflector, which reflector can be shaped so that lighting elements 35 illuminate the desired regions on faceplate 20.

The tritium gas in the tritium light elements is radioactive and will produce light when placed in a sealed glass container 36. In order to protect sealed glass container 36 from possible breakage or the like, sealed glass container 36 which contains the radioactive tritium gas is enclosed within a sealed sleeve 37. Sleeve 37 can be constructed from acrylic or other impact resistant material for further protecting glass container 36 from breakage and the consequent leakage of radioactive gas. A cushion 38 constructed from foam rubber or the like, supportingly secures tritium glass container 36 within sleeve 37 at both ends thereof. Properly sized plugs 32 are provided at both ends of sleeve 37 for hermetically sealing the tritium elements 36 therein. Accordingly, in addition to being contained within sealed glass container 36, the tritium gas within sealed glass container 36 is further protected by being hermetically sealed within sealed sleeve 37. Hence, should glass container 36 rupture or break, the tritium gas will not escape from sealed sleeve 37 thus preventing the leakage of any radioactive gas into the atmosphere.

It is noted that sealed sleeves 37 come in a variety of sizes depending on their intended use. As illustrated in the drawings, large sleeves 37*a* and small sleeves 37*b* are provided. Large sleeves 37*a* are adapted to be removably secured in large reflectors 30*a* by means of large clips 40*a* at both ends of large reflector 30*a*. Similarly, small sleeves 37*b* are adapted to be removably secured in small reflectors 30*b* by means of small clips 40*b* at both ends of small reflector 30*b*. Clips 40 are adapted to frictionally secure a sleeve 37 in reflector 30. It is noted that clips 30 come in a variety of sizes depending on the size of the lighting element 35 which it is to secure. Clips 40 are secured to reflectors 30 by means of rivets 41.

Tritium filled lighting elements 35 have a useful life of approximately ten years, with the illumination intensity provided by the tritium filled lighting elements 35 being reduced by 50% after approximately seven years. Depending on the desired lighting characteristics, lighting elements 35 can be provided with different intensities. Since lighting elements 35 are releasably secured by clips 40 in reflectors 30, they can be easily removed and replaced at the end of their useful life. Also, since lighting elements 35 contain radioactive tritium gas, a warning label 33 (FIGS. 4 and 7) as prescribed by the Nuclear Regulatory Commission, should be affixed on housing 10.

Sealed glass container 36 can be of various lengths and radii for selective placement within sleeve 37. For example, as illustrated in FIG. 3, sealed container 36*a* behind character T of the EXIT sign extends essentially along the lengthwise extent of sealed acrylic sleeve 37*a* for properly illuminating the T. However, sealed container 36*b* in sealed acrylic sleeve 37*b* is of a shorter length and is centralized within sealed sleeve 37*b* for properly illuminating the arrow behind which it is mounted.

Reflectors 30 include depending flanges 31 on both ends thereof. Depending flanges 31 allow for the selective releasable mounting of reflectors 30 in back frame 12 of housing 11. As aforenoted, back frame 12 includes extending shoulders 16. Extending shoulders 16*a* and 16*b* on top and bottom side walls 15*a* and 15*b*, respectively, have a series of holes 42 bored therethrough. Depending flanges 31 are adapted to rest on extending shoulders 16*a* and 16*b*. An L-shaped member 43 includes a series of holes 44 bored therein for cooperation with holes 42 in back frame 12. Screws 45 are adapted to secure L-shaped member 43 to extending shoulders 16 through holes 44 and 42. As illustrated, depending flanges 31 of reflectors 30 extend between L-shaped member 43 and extending shoulders 16*a* and 16*b* and are secured therebetween when L-shaped member 43 is fastened to extending shoulder 16 by means of screws 45. Accordingly, upon the removal of screws 45, reflectors 30, and hence lighting elements 35 secured thereon, can be selectively removed or repositioned in order to illuminate desired portions of faceplate 20.

It is noted that lower horizontal portion 43*a* of L-shaped member 43 supports the back surface 20*a* of faceplate 20. In combination with securing lip 19 of front frame 13, L-shaped member 43 secures faceplate 20 in housing 11. A clear plastic plate can be provided over faceplate 20 for protecting faceplate 20 from scratches or the like. Additionally, a diffuser 25 can be provided behind faceplate 20 for diffusing the light provided by lighting elements 35.

As illustrated in the drawings, a lighting element 35 can be provided for each character or symbol 21 on faceplate 20 in order to illuminate a given character or symbol. As illustrated in FIG. 1, the EXIT sign is provided with arrows on either side of EXIT. Should a user desire to have only one of the arrows illuminated, he would proceed in the following manner. Screws 23, which are preferably tamper resistant, such as socket drive screws, are removed and front frame 13 is lifted off of back frame 12. Faceplate 20 is then removed exposing lighting elements 35. Removal of screws 45 will release L-shaped members 43 which secure depending flanges 31 of reflectors 30 to back frame 12. Accordingly, the desired lighting fixtures 34 can be removed as desired. Sign 10 is then reconstructed with the undesirable portion of faceplate 20 being no longer illuminated. Additionally, by following the above procedure, faceplate 20 can be removed and a new faceplate bearing a different legend can be installed. Lighting fixtures 34 can be removed or repositioned so as to illuminate the desired portions of the new faceplate.

Alternatively, the desired lighting elements 35 can be removed from reflector 30 thereby removing the light illuminating the undesirable characters or symbols on faceplate 20. Since reflectors 30 selectively focus the light from lighting elements 35 onto the rear of faceplate 20 and hence through light transmitting characters or symbols 21, the undesired portions of faceplate 20 remain substantially unlighted.

Figure 7:
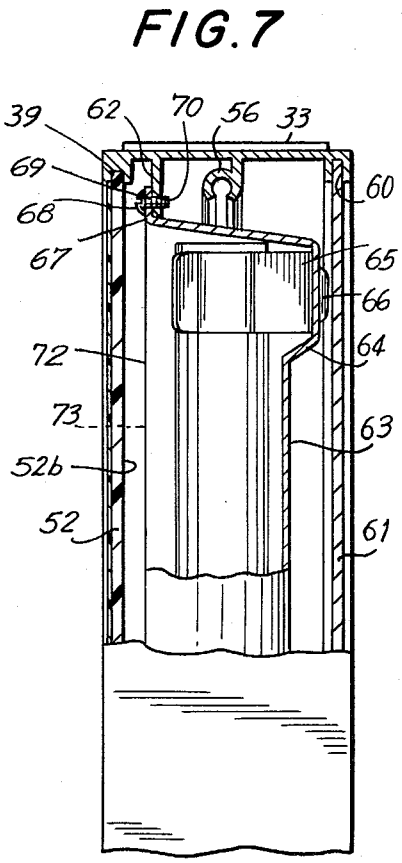
Figure 5:
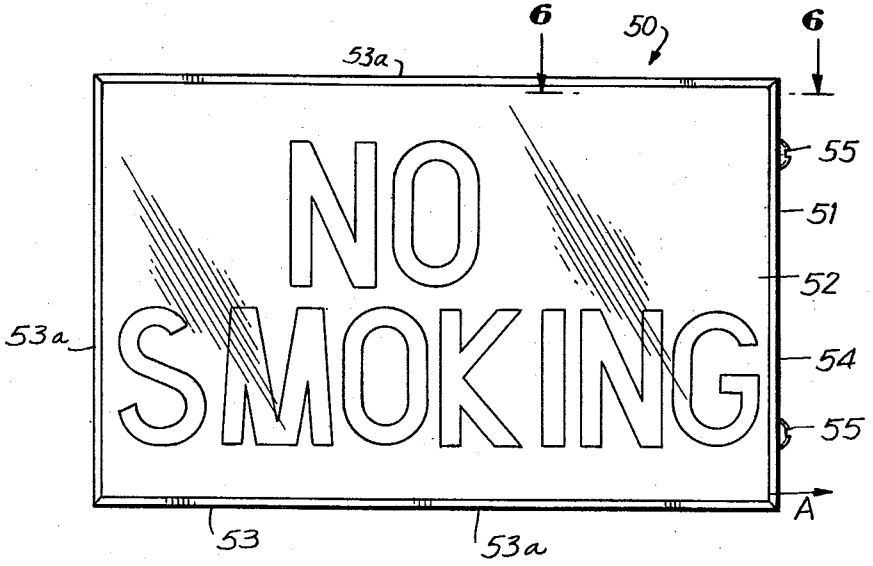
FIG. 5 is a front plan view of a self luminous safety sign constructed in accordance with an alternative embodiment of the instant invention.
Figure 6:
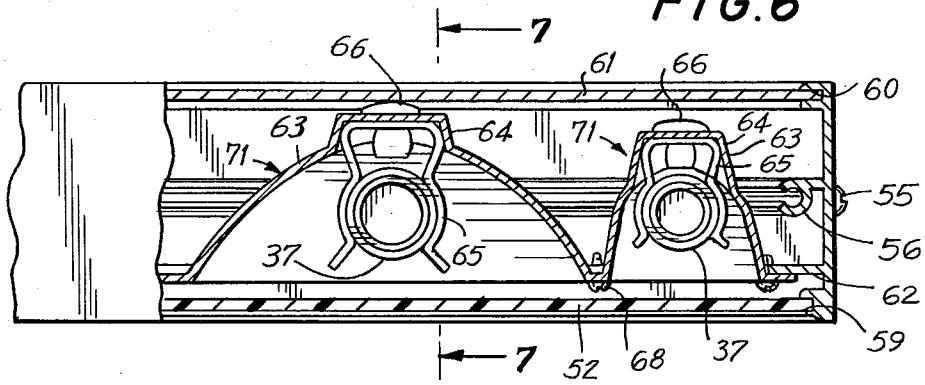
FIG. 6 is an enlarged sectional view taken along lines 6—6 of FIG. 5; and, FIG. 7 is a partial sectional view taken along lines 7—7 of FIG. 6.

Referring now to FIGS. 5 through 7 an alternative embodiment and construction of safety sign 50, constructed in accordance with the instant invention is depicted. Sign 50 includes a housing 51 and a faceplate 52 bearing the legend NO SMOKING. In this embodiment, housing 51 is formed from a four sided frame 53 having three integrally connected sides 53*a* to which the fourth side 54 is secured by means of screws 55. Screws 55 are adapted to be received into extending C-shaped member 56 which extends around the inner perimeter of housing 51. Each side 53*a* and 54 of frame 53 includes channels 59 and 60 along the front and rear edges of housing 51, respectively. Rear channel 60 is adapted to slidingly receive back plate 61 of housing 51. Front channel 59 is adapted to slidingly receive faceplate 52. Upon the removal of fourth side 54 from frame 53, faceplate 52 can be easily removed by sliding it out of front channel 59 in the direction of fourth side 54, as indicated by arrow A.

A depending arm 62 extends from sides 53*a* and 54 intermediate front channel 59 and C-shaped member 56 for supporting lighting fixtures 71. Light fixtures 71 include reflectors 63 which are generally parabolic in shape and can be constructed in various sizes in order to properly illuminate the desired characters. Parabolic reflectors 63 includes a bulge portion 64 at the top and bottom thereof for receiving fastening clip 65 therein. A rivet 66 secures clip 65 in bulge portion 64 of reflector 63. Clips 65 are adapted to releasably secure lighting element 35 in the manner discussed above.

It is noted that clips 65 can be replaced along with bulge portion 64 in reflector 63 with an alternative fastening system. A Velcro-type fastener could be affixed to each end of sleeve 37 and to each end of reflector 63 thereby providing an alternative securing method for the sleeve 37 in reflector 63.

Reflectors 63 include depending flanges 67 at each end thereof for securing reflectors 63 to depending arms 62 on housing 61. Screws 68 are inserted in holes 69 and 70 of depending flanges 67 and depending arms 63 respectively for releasably securing lighting fixtures 71 in housing 51. A clearance 72 between the rear surface 52*b* of faceplate 52 and imaginary line 73 defined by depending flanges 67 may be necessary in order to allow for even light distribution; at least one-eighth inch being generally required. Further, it is noted that back plate 61 can be contoured to receive a portion of parabolic reflector 63 in order to allow sufficient surface contact between parabolic reflector 63 and back plate 61. Also, screws 55 are preferably tamper proof so that housing 51 cannot be tampered with. Accordingly, light sleeves 37 therein are properly protected from misuse, theft or the like.

Housing 11 or 51 can be mounted in a plurality of ways depending on the desired location of the safety sign. For example, a template can be provided which can be positioned over the desired portion of housing 11 in order to allow holes 75 (FIG. 1) to be bored therein in order to allow for the desired mountings. As illustrated in FIG. 1, holes 75 on side wall 18 of housing 11 will allow the sign, with the proper mounting hardware, to be end mounted. Also, pendant mounting, extended ceiling mounting or recessed mounting utilizing flanged brackets, can be provided for.

The self-luminous safety sign of the instant invention, in accordance with the above description, provides a safety sign which allows for the easy changing of the faceplate, and, appropriately, removal or repositioning of the lighting fixtures for illuminating the desired portions of the faceplate. The lights themselves are self-luminous, requiring no external electrical connection, and are easily replaceable upon expiration.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A safety sign manufactured for use by a consumer comprising a housing adapted to support either of at least a first and second legend-bearing means, said first legend-bearing means having at least one character for illumination thereon and being removably securable in said housing by said consumer, self-luminous lighting means for illuminating said at least one character on said first legend-bearing means when said first legend-bearing means is secured in said housing, said self-luminous lighting means including a radioactive gas and container means in which said gas is sealed, said self-luminous lighting means further including an impact-resistant sleeve means in which said container means is selectively mounted, and securing means for selectively and adjustably securing said lighting means in said housing in a first position so that said at least one character on said first legend-bearing means is illuminated by said lighting means, said securing means allowing for the consumer to reposition said lighting means in said housing to illuminate a character on said second legend-bearing means in a different position than said at least one character on said first legend-bearing means when said first legend-bearing means is removed from said housing and replaced by said second legend-bearing means by said consumer.

2. A safety sign as claimed in claim 1, wherein said securing means is adapted to allow for the positioning of said lighting means in said housing in a plurality of locations for the illumination of a second character on said first legend-bearing means.

3. A safety sign as claimed in claim 2, wherein said first legend-bearing means includes a faceplate, said faceplate including means for defining characters, said securing means being adapted to allow for the selective positioning of said lighting means in said housing behind at least one of said characters for the selective illumination of said at least one character.

4. A safety sign as claimed in claim 3, further comprising a plurality of self-luminous lighting means and means for selectively and adjustably positioning said plurality of lighting means in said housing behind said faceplate in a plurality of locations so that said characters can be selectively illuminated.

5. A safety sign as claimed in claim 4, wherein each said self-luminous lighting means includes tritium-gas filled container means for producing light.

6. A safety sign as claimed in claim 5, wherein said self-luminous lighting means includes means for focussing said light on said characters.

7. A safety sign as claimed in claim 6, wherein said housing includes a front frame and a back frame, and means for releasably securing said front frame to said back frame, said faceplate being removably mounted in said housing intermediate said front and back frames, said plurality of lighting means being selectively securable in said back frame behind said faceplate for the selective illumination of said characters.

8. A safety sign as claimed in claim 7, wherein said back frame includes top and bottom walls, said top and bottom walls each having a shoulder extending substantially perpendicular therefrom, said plurality of lighting means being selectively securable to said shoulders for the selective illumination of said characters.

9. A safety sign as claimed in claim 8, wherein said focussing means includes reflector means for selectively focussing said light on selected portions of said faceplate, said container means being releasably securable in said reflector means, said reflector means including depending flanges at each end thereof, said depending flanges of said reflector means being selectively releasably securable to said shoulders, respectively, for the selective positioning of said lighting means in said housing.

10. A safety sign as claimed in claim 9, wherein said front frame includes four walls, at least two opposing walls each having an extending lip, said faceplate being secured intermediate said front and back frames by said securing lips and said shoulders, respectively.

11. A safety sign as claimed in claim 10, wherein said means for selectively securing said lighting means in said housing includes two L-shaped means, one said L-shaped means acting in cooperation with one said shoulder, said depending flanges of said reflector means being releasably securable intermediate said L-shaped means and said shoulders, said faceplate being releasably securable in said housing intermediate said L-shaped means and said extending lips.

12. A safety sign as claimed in claim 6, wherein said housing includes a four-sided frame, one said side of said frame being removable from said frame so that said faceplate can be removed therefrom.

13. A safety sign as claimed in claim 12, wherein said frame includes a channel therearound for slidingly receiving said faceplate.

14. A safety sign as claimed in claim 13, wherein said frame includes a depending arm therearound, said focussing means including reflector means for selectively focussing said light on selected portions of said faceplate, said container means being releasably securable in said reflector means, said reflector means having depending flanges, said flanges being releasably securable to said depending arms so that each said lighting means can be releasably secured in selected positions in said housing.

15. A safety sign as claimed in claims 5, 9 or 14, wherein each said lighting means includes an impact-resistant sleeve means, at least one said container means being selectively mountable within said sleeve means.

16. A safety sign as claimed in claim 15, wherein each said sleeve means includes cushioning means for cushioning said container means in said sleeve means.

17. A safety sign as claimed in claim 16, wherein each said sleeve means includes plug means at both ends thereof for hermetically sealing said tritium-gas filled container means in said sleeve means.

18. A safety sign as claimed in claims 9 or 14, wherein said reflector means includes clip means at both ends thereof for frictionally securing said container means therein.

19. A safety sign as claimed in claims 9 or 14, wherein said reflector means and said container means include a Velcro fastening means for releasably securing said container means in said reflector means.

20. A safety sign as claimed in claim 14, wherein said frame includes a second channel, said channel being adapted to receive a back plate, said back plate including contoured sections for conformingly receiving a portion of said reflector means so that said reflector means are properly secured in said housing.

21. A safety sign as claimed in claims 6, 9 or 14, wherein said faceplate includes openings for allowing said light to pass therethrough.

22. A safety sign as claimed in claims 6, 9 or 14, wherein said faceplate includes translucent regions for allowing said light to pass therethrough.

* * * * *